US005433630A

United States Patent [19]

Inaba et al.

[11] Patent Number: 5,433,630

[45] Date of Patent: Jul. 18, 1995

[54] SPRING-INCORPORATED FLAT TYPE TERMINAL STRUCTURE

[75] Inventors: Shigemitsu Inaba; Shigemi Hashizawa; Hidehiko Kuboshima, all of Shizuoka, Japan

[73] Assignee: Yazaki Corporation, Tokyo, Japan

[21] Appl. No.: 228,895

[22] Filed: Apr. 18, 1994

[30] Foreign Application Priority Data

Apr. 16, 1993 [JP] Japan ..... 5-112405

[51] Int. Cl.[6] ..... H01R 13/187

[52] U.S. Cl. ..... 439/843; 439/287

[58] Field of Search ..... 439/287–289, 439/842, 843, 854, 855, 607

[56] References Cited

U.S. PATENT DOCUMENTS

| | | | |
|---|---|---|---|
| 3,489,986 | 1/1970 | Frederick | 439/287 |
| 4,932,888 | 6/1990 | Senor | 439/607 |
| 5,067,914 | 11/1991 | Seidel et al. | 439/607 |
| 5,261,840 | 11/1993 | Benz | 439/843 |

FOREIGN PATENT DOCUMENTS

| | | | |
|---|---|---|---|
| 1665132 | 1/1971 | Germany | 439/843 |

*Primary Examiner*—David L. Pirlot
*Assistant Examiner*—Jill DeMello
*Attorney, Agent, or Firm*—Sughrue, Mion, Zinn, Macpeak & Seas

[57] ABSTRACT

A spring-incorporated flat type terminal structure which can be manufactured efficiently and which requires only a small space for engagement or disengagement of the male and female parts of the terminals of the connector. A flat type female terminal of electrically conductive material has a terminal engaging section and a wire connecting section. The terminal engaging section is substantially in the form of a rectangular box and has a terminal accommodating chamber with a terminal inserting inlet opened in one side. The terminal inserting inlet has four locking grooves at the four corners of the inserting inlet to hold spacer springs. The wire connecting section has an engaging hole into which the conductor of an electrical wire W is inserted. Hence, by inserting the engaging piece of a flat type male connector into the terminal engaging section from above, the wire of the flat type female connector can be electrically connected to the wire of the flat type male connector.

6 Claims, 4 Drawing Sheets

C-C

SPRING-INCORPORATED FLAT TYPE TERMINAL STRUCTURE

BACKGROUND OF THE INVENTION

1. Field of The Invention

The present invention relates to a spring-incorporated flat type terminal structure which is used in a limited space, e.g., in an electric vehicle, and is suitable for connection of electrical wires, which have a large current capacity.

2. Description Of The Prior Art

A variety of connecting terminals for wires having a large current capacity, such as used in electric vehicles, have been proposed. A first example of conventional connecting connectors is a round type machined terminal 1, as shown in FIG. 8. The machined terminal comprises a cylindrical terminal engaging section 2 and a wire connecting section 3, which is coaxial with the cylindrical terminal engaging section 2 and is connected to a large current wire W (FIG. 9).

As shown in FIG. 9, which is a sectional view taken along line D—D of FIG. 8, the terminal engaging section 2 includes a hollow cylindrical portion, the inside diameter of which is larger than the diameter of the opening of a terminal inserting hole 2*a*. A cylindrical spring 4, which is flexible, is accommodated in the hollow cylindrical portion 2*b*. When a male terminal having a circular cross section is inserted into the machined terminal, the cylindrical spring 4 is compressed radially, so that the male terminal is electrically connected through the cylindrical spring 4 to the inner cylindrical surface of the hollow cylindrical portion 2*b*.

As shown in FIG. 10, the cylindrical spring 4 has a plurality of protrusions 4*c* at both ends to lock itself in the hollow cylindrical portion 2*b* and to guide the male terminal into the terminal 1. A plurality of slits 4*b* are cut in the body of the cylindrical spring to form contact portions 4*a* between the slits 4*b*. The contact portions 4*a* are bent inwardly to contact the male terminal when the latter is inserted into the terminal 1.

A second example of a conventional connecting terminal is a round type machined terminal disclosed by Japanese Patent Application (OPI) No. 124383/1988 (the term "OPI" as used herein means an "unexamined application"). In the round type machined terminal of the latter OPI, a sleeve on the inner wall surface, on which a flat-plate-shaped spring is mounted, is fitted in a cylindrical supporting member corresponding to the terminal engaging section, thus forming a terminal engaging section similar to the one in the above-described first example.

Connecting terminals in an electric vehicle use heavy wires to handle large currents. Hence, in disengaging the connecting terminals, it is considerably difficult to retract or bend them, even in the case of a single connecting terminal. It is even more difficult in a narrow vehicle to obtain the requisite space, which is large enough to bend the terminal.

A connecting terminal for handling large currents should have a large enough electrical contact surface to suppress the generation of heat; however, round type machined terminals do not have such large contact surfaces.

Additionally, in the connecting terminal of the above first example, in order to lock the spring, it is necessary to form undercuts in the inner cylindrical surface of the hollow cylindrical portion. On the other hand, the connecting terminal of the second example requires a sleeve to fixedly accommodate the spring, and this increases the number of components and, accordingly, the manufacturing cost of the connecting terminal.

SUMMARY OF THE INVENTION

An object of the present invention is to provide a spring-incorporated flat type terminal structure which can be readily formed and which requires only a small space when connected to and disconnected from the mating terminal.

The foregoing object of the invention has been achieved by the provision of a spring-incorporated flat type terminal structure made of electrically conductive material which comprises: a terminal engaging section on one side in which a spring member is incorporated; and a wire connecting section on the other side in which the terminal engaging section is substantially in the form of a rectangular parallelepiped, having a cylindrical wire connecting section on one side in such a manner that the wire connecting section is extended perpendicular to the terminal engaging section, the terminal engaging section having a terminal accommodating chamber with a terminal inserting inlet on the other side so as to receive a connecting terminal which, when engaging, is moved in a direction perpendicular to a wire connecting direction; and a flat-plate-shaped spacer spring fixedly held on at least one of the inner wall surfaces of the terminal accommodating chamber.

More specifically, in the spring-incorporated flat type terminal structure, the spacer spring has locking shoulders and elastic portions, which are curved alternately in the opposite directions. The spacer spring is fixedly held on the inner wall surface of the terminal accommodating chamber by deforming the locking grooves formed in the terminal inserting inlet at the corners with the locking shoulders engaged with locking grooves.

In the spring-incorporated flat type terminal structure according to the invention, the flat-plate-shaped spacer spring is inserted through the terminal inserting inlet of the rectangular-box-shaped terminal engaging section as it is until the shoulders are held in the locking grooves, and, under this condition, the engaging grooves are deformed to fixedly hold the spacer spring in the terminal accommodating chamber.

The terminal inserting inlet is opened upwardly, i.e., in a direction perpendicular to the wire connecting direction. Hence, when a mating connecting terminal is to be engaged with the flat type terminal structure of the invention, it is moved upwardly as much as the height of the terminal engaging section, and then engaged with it from above. Hence, with the spring-incorporated flat type terminal structure of the invention, it is unnecessary to bend forcibly the heavy wire; that is, the connecting operation can be achieved with ease.

BRIEF DESCRIPTION OF THE DRAWINGS

This invention will be described with reference to FIGS. 1–7.

DETAILED DESCRIPTION OF THE INVENTION

Figure 1:
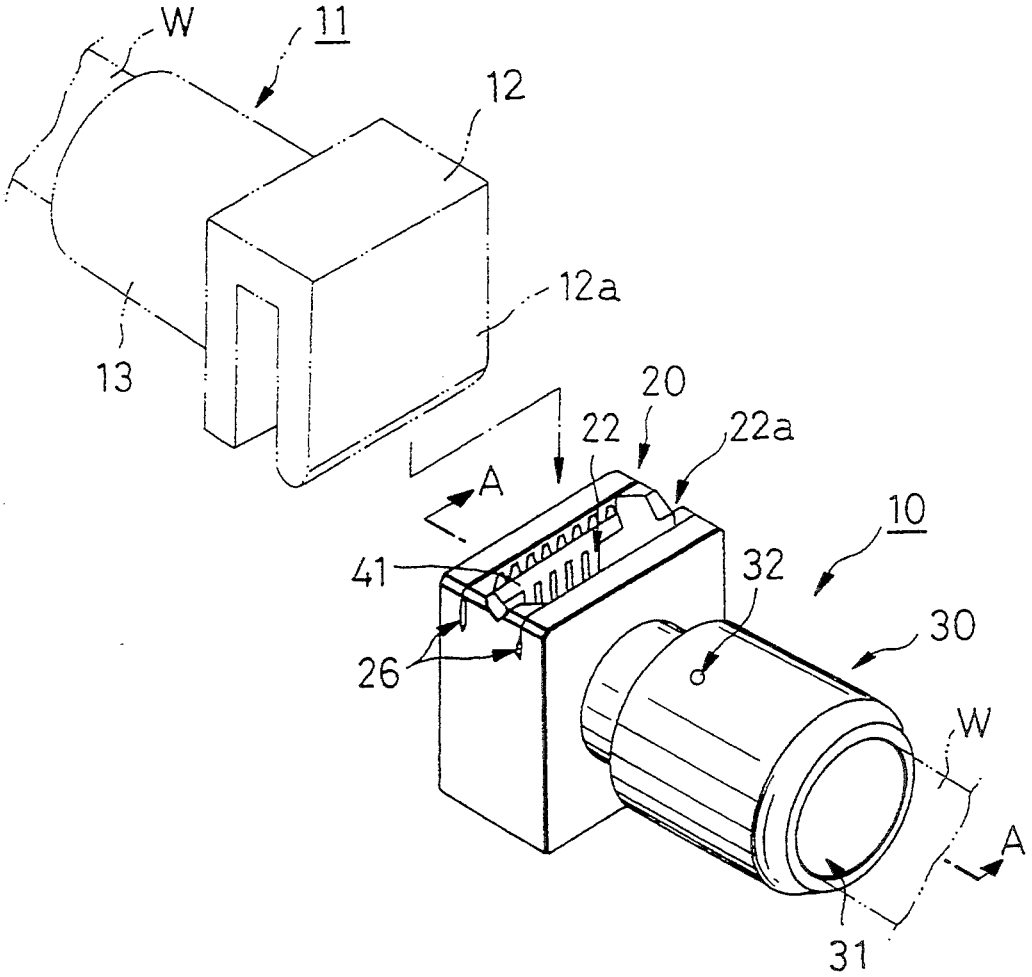
FIG. 1 is a perspective view showing the engaging structure of a flat type terminal, which is one embodiment of the invention.
Figure 4:
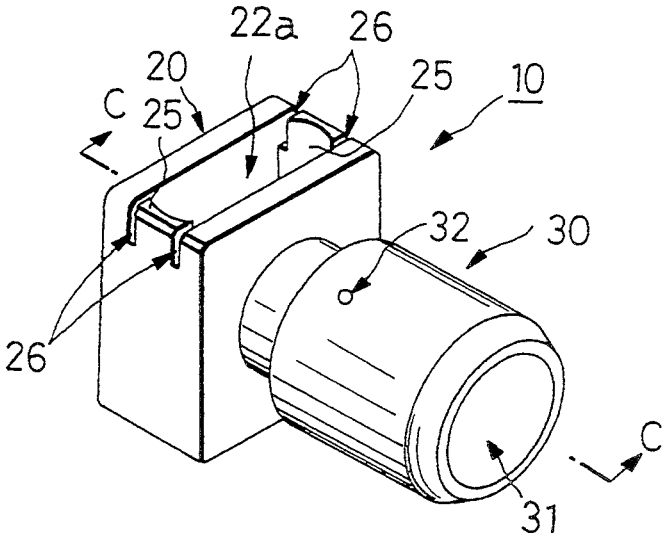
FIG. 4 is a perspective view of the flat type terminal of FIG. 1, before the spacer springs are inserted.
Figure 5:
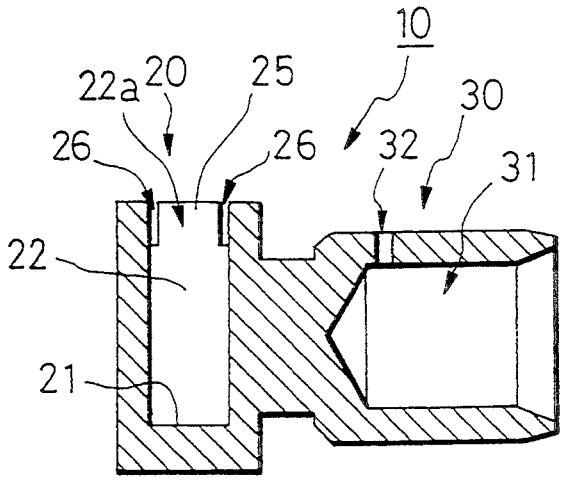
FIG. 5 is a sectional view taken along line C—C in FIG. 4.

As shown in FIG. 1, a flat type female terminal 10, made of electrically conductive material, comprises a terminal engaging section 20 and a wire connecting section 30. As shown in FIGS. 4 and 5, the terminal engaging section 20 is in the form of a rectangular box; that is, it has a terminal accommodating chamber 22 with a terminal inserting inlet 22*a* in one side. The terminal inserting inlet 22*a* has four locking grooves 26 positioned, respectively, at the four corners of the inlet, to hold spacer springs 41 (described below). The locking grooves are best seen in FIGS. 4 and 5. The wire connecting section 30 has an engaging hole 31 into which the conductor of an electrical wire W is fixedly inserted. In order to prevent the compression of the air in the engaging hole 31 when the wire W is inserted, in the back of the wire connecting section there is an air vent hole 32 that communicates with the engaging hole 31.

A flat type male terminal 11 made of electrically conducive material comprises an engaging section 12, having a U-shaped section, and a wire connecting section 13. The engaging section 12 includes an engaging piece 12*a*, which is inserted into the terminal inserting inlet 22*a* from above to electrically connect the electrical wires W of the male and female terminals to each other.

Figure 2:
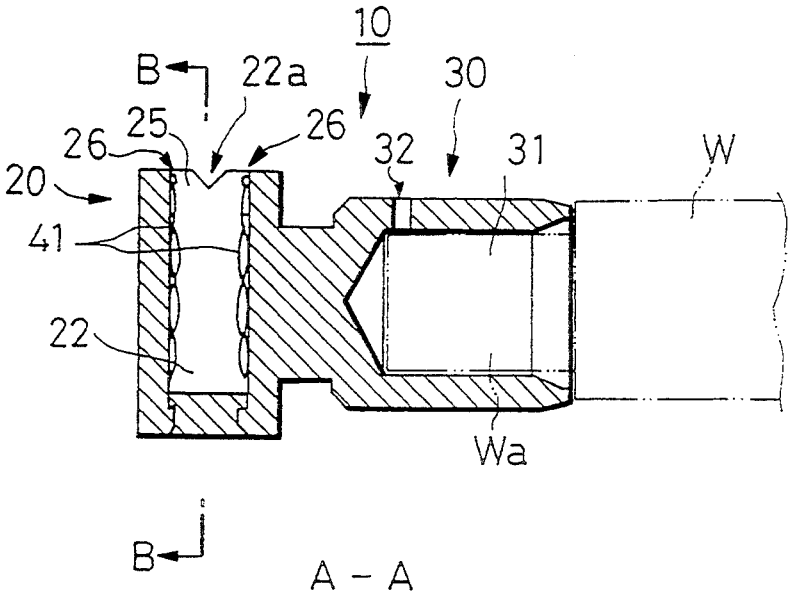
FIG. 2 is a sectional view taken along line A—A in FIG. 1.
Figure 3:
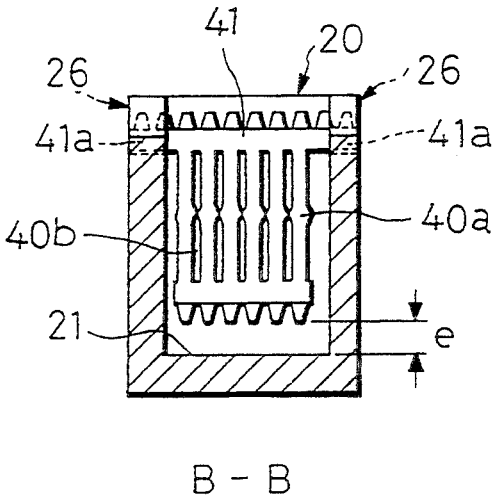
FIG. 3 is a sectional view taken along line B—B in FIG. 2.
Figure 6:
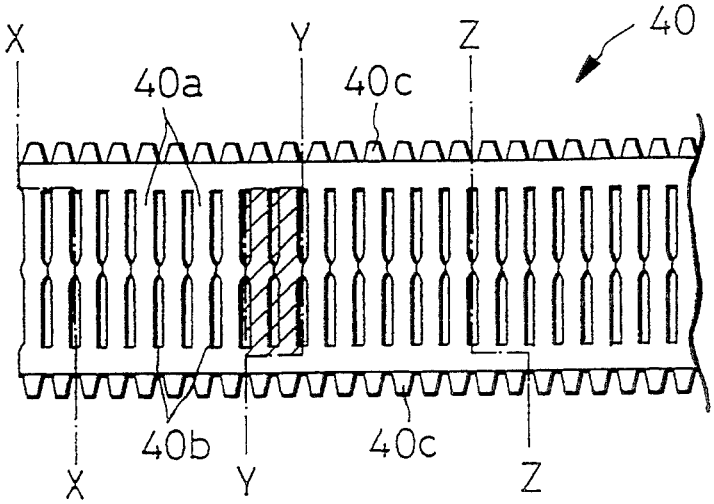
FIG. 6 is a plan view showing a series of spacer springs formed on a base material.
Figure 7:
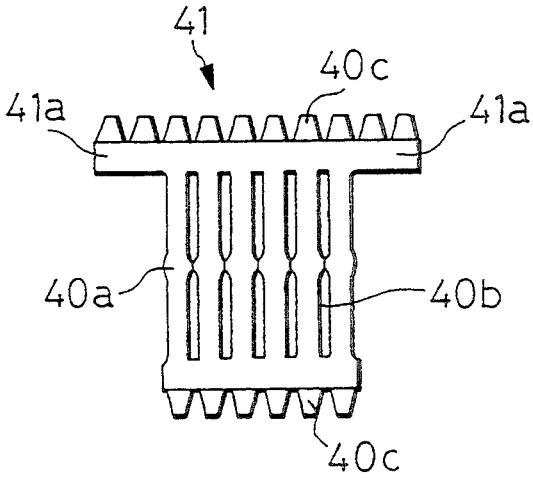
FIG. 7 is a plan view showing only one of the spacer springs.
Figure 8:
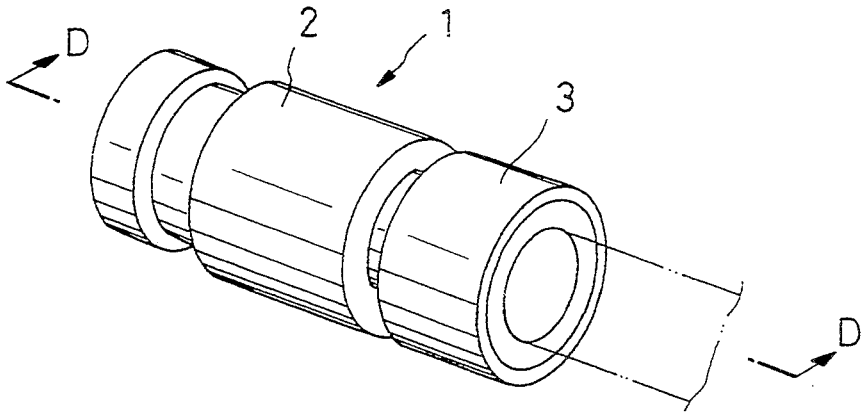
FIG. 8 is a perspective view of a conventional round type terminal.
Figure 9:
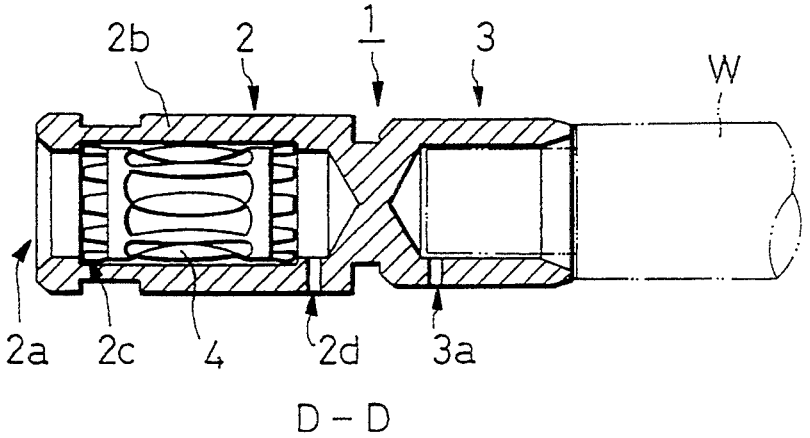
FIG. 9 is a sectional view taken along line D—D in FIG. 8.
Figure 10:
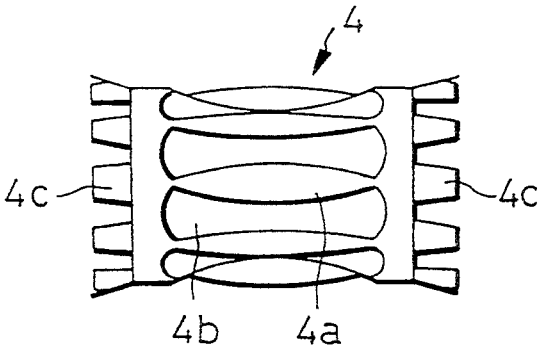
FIG. 10 is a plan view of a cylindrical spring used in the conventional round type terminal.

The spacer springs 41 of FIGS. 1–3 are formed as shown in FIG. 6. That is, by blanking a thin plate of phosphor bronze, a belt-shaped base material 40 is formed with a number of slits 40*b* arranged on both sides of the center line at predetermined intervals in such a manner that the slits 40*b* are located symmetrical with respect to the center line, and protrusions 40*c* arranged on both edges at predetermined intervals. The remaining portions, namely, contact portions 40*a* between the slit 40*b*, are alternately curved in opposite directions, and the upper part and the lower part of each of the contact portions 40*a* are also curved in the opposite directions.

The belt-shaped base material thus formed includes a number of spacer springs 41. To obtain the spacer springs 41 from the belt shaped base material 40, the material 40 is cut, for instance, along lines X—X, Y—Y and Z—Z, as shown in FIG. 6, to minimize waste (the wasted portion is indicated by hatching). Each of the spacer springs 41 thus formed has two shoulders 41*a* at both ends of the upper edge. The shoulders engage with the locking grooves 25 of the terminal engaging section 20.

As shown in FIGS. 2 and 3, each of the spacer springs 41 is inserted through the terminal inserting inlet 22*a* until its shoulders 41*a* are locked in the locking grooves 26. Under this condition, the upper end of the side wall 25 is deformed with a tool such as a chisel until the locking grooves 26 collapse to hold the shoulders 41*a* of one of the spacer springs 41. Thus, the spacer springs 41 are fixed into position and held on the inner surface of the terminal inserting inlet 22*a*.

The lower end of the spacer spring 41 is spaced above the bottom 21 of the terminal engaging section 20 by the distance e. This spacing serves the following purpose. When the mating flat type male terminal 11 (FIG. 1) is inserted into the terminal engaging section 20 with the spacer springs 41, the curved contact portions 40*a* of the spacer springs 41 collapse towards the inner wall surfaces causing the springs to elongate downwardly. The distance e between the lower end of the spacer spring 41 and the bottom 21 of the terminal engaging section 20 permits the elongation to occur.

The conductor Wa of the wire W is inserted into the engaging hole 31, after which the wire connecting section 30 is compressed with a suitable tool until the conductor Wa is fixed in position and held in the engaging hole 31.

In the spring-incorporated flat type terminal structure as described above, the terminal accommodating chamber is formed having a terminal inserting inlet in one side thereof (the top) so that insertion of the mating connecting terminal can be made in a direction perpendicular to the wire connecting direction. Hence, when the terminals are engaged with one another or disengaged from each other, it is unnecessary to bend the heavy wire, and the space required for engagement and disengagement of the terminal may be considerably small.

The terminal engaging section is substantially in the form of a rectangular parallelepiped. In mounting the spacer springs on the respective inner wall surfaces of the terminal accommodating chamber, each of the spacer springs is inserted into the terminal accommodating chamber as it is until its shoulders are held by the looking grooves and, under this condition, the upper ends of the side walls are deformed so that the spacer spring is fixedly held there. Hence, it is unnecessary to form undercuts to fixedly hold the spacer spring. This means that the number of manufacturing steps is decreased, and the manufacturing cost is also greatly reduced.

What is claimed:

1. A wire connector female terminal for connecting with a wire connector male terminal, comprising:

a terminal engaging section for receiving a connecting portion of said male terminal;

a wire connecting section opposite said terminal engaging section and electrically and physically connected to said terminal engaging section;

said terminal engaging section having the form substantially of a rectangular parallelepiped, and said wire connecting section having a cylindrical shape and extending perpendicularly from said terminal engaging section, said terminal engaging section having a terminal accommodating chamber having inner wall surfaces and a terminal inserting inlet positioned to receive said connecting portion of said male terminal, whereby, when said male terminal and said female terminal are engaged or disengaged they are moved in a direction perpendicular to the axes of the wires connected by said male and female terminals, and a flat-plate-shaped spacer spring fixed in position and held on at least one of said inner wall surfaces of said terminal accommodating chamber.

2. A female terminal as claimed in claim 1, wherein:

said spacer spring has locking shoulders and elastic portions curved alternately in opposite directions;

said terminal engaging section having locking grooves formed in the walls thereof at said terminal inserting inlet; and said locking shoulders being engaged with said locking grooves, which are deformed to fix into position and to hold said spacer spring on said inner wall surface of said terminal accommodating chamber.

3. The female terminal as claimed in claim 2, further comprising:

a second flat-plate-shaped spacer spring having locking shoulders and elastic portions curved alternately in opposite directions, with said locking shoulders of said second spacer spring being engaged with said locking grooves, which are deformed to fix into position and to hold said second spacer spring on an inner wall surface of said terminal accommodating chamber opposite said inner wall surface on which is said first mentioned spacer spring.

4. The female terminal as claimed in claim 3, wherein each of said spacer springs has a generally T shaped flat form, with the head of the T forming the locking shoulders and with the bottom of the T extending in said accommodating chamber in a direction away from said terminal inserting inlet, and wherein prior to insertion of said male connecting portion, said elastic portions are not compressed and the length of said spacer spring is less than the length of each of said inner wall surfaces such that when the male connector portion is inserted the elastic portions are compressed and the spacer springs are elongated thereby.

5. The female terminal as claimed in claim 4, wherein each of said spacer springs has lengthwise slits therein and lengthwise curved contact portions; said curved contact portions being said elastic portions and being alternatingly curved toward said inner wall and away from said inner wall.

6. The female terminal as claimed in claim 1, wherein said terminal engaging section includes four of said inner wall surfaces which surround said male terminal when received in said terminal accommodating chamber.

* * * * *